US009842451B2

(12) United States Patent
Peinze et al.

(10) Patent No.: US 9,842,451 B2
(45) Date of Patent: Dec. 12, 2017

(54) SECURITY FEATURE AND VALUE PRODUCT AND/OR SECURITY PRODUCT CONTAINING THE SECURITY FEATURE

(71) Applicant: BUNDESDRUCKEREI GMBH, Berlin (DE)

(72) Inventors: Franziska Peinze, Berlin (DE); Arthur Mathea, Berlin (DE)

(73) Assignee: Bundesdruckerei GmbH, Berlin (DE)

( * ) Notice: Subject to any disclaimer, the term of this patent is extended or adjusted under 35 U.S.C. 154(b) by 0 days.

(21) Appl. No.: 14/433,130

(22) PCT Filed: Oct. 1, 2013

(86) PCT No.: PCT/EP2013/070456
§ 371 (c)(1),
(2) Date: Jun. 10, 2015

(87) PCT Pub. No.: WO2014/053490
PCT Pub. Date: Apr. 10, 2014

(65) Prior Publication Data

US 2015/0339873 A1 Nov. 26, 2015

(30) Foreign Application Priority Data

Oct. 2, 2012 (DE) ..... 10 2012 218 053

(51) Int. Cl.

| | |
|---|---|
| ***G07D 7/00*** | (2016.01) |
| ***G07D 7/2033*** | (2016.01) |
| ***B42D 25/00*** | (2014.01) |
| ***G07D 7/005*** | (2016.01) |
| *B42D 25/387* | (2014.01) |

(52) U.S. Cl.
CPC ..... *G07D 7/0066* (2013.01); *B42D 25/00* (2014.10); *G07D 7/0054* (2017.05); *G07D 7/2033* (2013.01); *B42D 25/387* (2014.10)

(58) Field of Classification Search
CPC ..... B42D 15/00
See application file for complete search history.

(56) References Cited

U.S. PATENT DOCUMENTS

| | | | |
|---|---|---|---|
| 3,474,027 | A | 10/1969 | Vautrain et al. |
| 8,478,080 | B2 | 7/2013 | Springmann et al. |
| 8,808,577 | B2 | 8/2014 | Becker et al. |
| 8,840,983 | B2 | 9/2014 | Downing |

(Continued)

FOREIGN PATENT DOCUMENTS

| | | | |
|---|---|---|---|
| DE | 19860093 | A1 | 7/2000 |
| DE | 19906388 | A1 | 8/2000 |

(Continued)

*Primary Examiner* — David Porta
*Assistant Examiner* — Hugh H Maupin
(74) *Attorney, Agent, or Firm* — Laurence A. Greenberg; Werner H. Stemer; Ralph E. Locher

(57) ABSTRACT

An easily producible security feature according to the invention contains at least one luminescence device on and/or in a product carrier. Additionally, the security feature contains, in and/or on the product carrier, at least one absorptive spectral filter for luminescence radiation exiting from the at least one luminescence device, such that a color impression results both under illumination with visible radiation and under luminescence illumination conditions.

8 Claims, 6 Drawing Sheets

(56) References Cited

U.S. PATENT DOCUMENTS

| | | | | |
|---|---|---|---|---|
| 2002/0022112 | A1 | 2/2002 | Hoeppner et al. | |
| 2006/0201362 | A1* | 9/2006 | Dumery et al. | 101/483 |
| 2012/0043751 | A1* | 2/2012 | Hersch et al. | 283/92 |
| 2012/0080877 | A1* | 4/2012 | Downing | 283/67 |

FOREIGN PATENT DOCUMENTS

| | | | |
|---|---|---|---|
| DE | 19907940 | A1 | 8/2000 |
| DE | 102007018450 | A1 | 10/2008 |
| DE | 102007035592 | A1 | 2/2009 |
| DE | 102008012423 | A1 | 5/2009 |
| EP | 0975148 | A1 | 1/2000 |
| WO | 2005108107 | A1 | 11/2005 |
| WO | 2007005354 | A2 | 1/2007 |
| WO | 2009018616 | A1 | 2/2009 |

* cited by examiner

SECURITY FEATURE AND VALUE PRODUCT AND/OR SECURITY PRODUCT CONTAINING THE SECURITY FEATURE

BACKGROUND OF THE INVENTION

Field of the Invention

The present invention relates to a security feature, to a valuable and/or security product, in particular a valuable and/or security document, containing said security feature, and to a manufacturing method for the valuable and/or security product. Such a valuable and/or security document can be, for example, a passport, identity document, driver's license or another ID card or payment instrument, in particular a banknote. In the case of an identity document, the front side thereof for example carries the photograph and the name of the owner. Such documents are typically produced in standardized formats, for example in the ID-1, ID-2 or ID-3 format according to ISO 7810. The documents can be made in principle from an organic polymer or a ceramic material, paper, cardboard or metal, or can contain them. Cards and card-like constituents of book-type documents can be produced preferably from polymer films which are laminated together.

The security features incorporated in the valuable and/or security documents can serve exclusively for proving the genuineness of the products, independently of the type or user thereof. Such security features are, for example, colored fibres, guilloches, the special paper of banknotes and the like. Individualized, for example personalized, security features moreover contain, in coded form or also in clear writing, an item of information relating to the type of document, to the use of said document or to an object with which the document is uniquely associated. Such information can be a facial image (photo) of the user, his personal data, such as the name, the date of birth, the place of birth, the signature or a personal identifier, such as a membership number. Another security feature individualizing the document can be, for example, a serial number of the document.

DE 10 2007 018 450 A1 discloses a laminated security document which is present in the form of a composite document which has at least one internal sheet and at least two overlay films covering the internal sheet. The internal sheet contains a color photograph carrying the facial image of the document owner. The color photograph is an exposed positive-positive silver colorant bleach photo emulsion. It is also known to produce the facial image of a person on an identity or security document using print technology. DE 199 06 388 A1 makes reference thereto. Said document relates to a method and an apparatus for personalizing and verifying such documents.

DE 10 2008 012 423 A1 specifies for example a security and/or valuable document having an individualizing security feature. Said document is configured as a polymer layer composite which is produced by laminating a plurality of substrate layers and in which at least one individualizing item of information is stored using print technology. The information is decomposed in the composite into at least two print extracts which each comprise part of the information. The at least two print extracts are arranged in at least two spaced-apart planes. In one embodiment specified in this document, provision is made for a printed image embodying the information to be decomposed into image points, and for each image point to have associated with it exactly one of the at least two print extracts. For example, the print can reproduce a facial image. In order to produce the document, the print extracts are printed onto the substrate layers. After laminating the printed substrate layers, the printed surfaces are located inside the document. In a further embodiment, it is possible to apply luminescence means onto a substrate layer surface arranged underneath the print extracts such that, under UV excitation, white light is emitted over the area. The light is filtered by the image points of the print extracts that are arranged thereabove such that the information can be seen in color preferably in vertical plan view.

Also known is the production of a blackening, for example in the form of a portrait photo of an ID card's owner, a signature or the like (EP 0 975 148 A) using a laser engraving in a radiation-sensitive layer. In this way, security features can be produced using a laser by way of engraving for example also in a layer located inside a multi-layer laminated carrier material (DE 199 07 940 A1). However, only blackenings are produced by the laser engraving, such that the resulting individualizing security feature is produced only in a black-and-white representation.

However, there is a constant need for novel, in particular individualizing, for example personalizing, security features which are secured against forgery and/or falsification and/or copying and are easily identifiable by a person for the purposes of associating the information coded therewith with the user and/or the object. By way of example, the security feature should be located in an internal product sheet which is secured against forgery and/or falsification and/or copying. Alternatively, the security feature can also be used to secure a personalization on an external product sheet. The present invention moreover specifies as an essential further object the provision of a cost-effective security feature that is easy and quick to realize.

To the extent that the term "valuable and/or security product" and in particular the term "valuable and/or security document" are mentioned in the description and the claims of the present application, they refer to a passport, identity document, driver's license or another ID card, or an access passport, a vehicle registration document, vehicle title document, visa, check, payment instrument, in particular a banknote, a check card, bank card, credit card or cash card, customer card, health card, chip card, a company ID, credentials, membership ID, gift card or shopping voucher, bill of lading or other credentials, revenue stamps, postal stamps, ticket, (gaming) chips, sticky label (for example for securing products) or another ID document. The product can be, for example, a smart card. The security and/or valuable document can be present in the ID-1, ID-2, ID-3 or in another format, for example in the form of a booklet, as in the case of a passport-like object. A security and/or valuable product is generally a laminate of a plurality of document sheets, which are connected to one another areally in accurate alignment under the action of heat and increased pressure. These products should meet the standard requirements, for example ISO 10373, ISO/IEC 7810, ISO 14443. The product sheets consist, for example, of a carrier material suitable for lamination. The term "valuable and/or security product" also includes, in addition to valuable and/or security documents, patches, labels and the like, which are, as security elements, constituent parts of the documents and are to this effect connected non-releasably to the document carrier or will form the security feature here.

To the extent that the description and the claims of the present application mention the term "security feature," this term is understood to mean, according to the present invention, the totality of optically active materials, that is to say the at least one luminescence means and the at least one absorptive spectral filter means which are arranged relative to one another such that a visually perceivable pattern is formed. The security feature can be produced as a constituent part of a valuable and/or security document or as a separate product (security element), which is connected non-releasably to a valuable and/or security document, for example as a patch, label or the like. This can be adhesively stuck, for example, onto the document, wherein a lacquer can also be used as the adhesive. The security feature will generally only cover part of the surface of the document.

To the extent that the description and the claims of the present application mention the term "luminescence," this is understood to mean fluorescence, phosphorescence, specifically both with Stokes and anti-Stokes shift. According to the present invention, this preferably also means photoluminescence. Furthermore, the luminescence can, for example, also be electroluminescence.

To the extent that the description and the claims of the present application mention the term "pattern," this is understood to mean any type of distribution of any type of visible elements, preferably in a two-dimensional arrangement, which form a representation that is closed in itself, for example an image, image element, character, in particular an alphanumeric character, a symbol, emblem, a formula or the like.

To the extent that the description and the claims of the present application mention the term "pattern element," this is understood to mean a constituent part of a pattern. A pattern element serves as the smallest structural element for forming the pattern, with all pattern elements forming the pattern. The material forming a pattern element can be transparent, translucent or opaque. Furthermore, it can exhibit a specific brightness (absorption, remission), i.e. it can have for example a blackening, grey hue or white hue, and/or it can have a "spectral" coloration and therein in turn a specific brightness. The pattern elements can have a circular (dot-like), rectangular, square, hexagonal or another shape. Pattern elements can be the smallest elements of a perceivable representation, with which in each case one of the color values or color tones can be associated in a color space (subtractive CMYK color space, additive RGB color space). The individual pattern elements, however, can also be composed of image points, such that a pattern element is formed from a plurality of primary colors of the color space to form the respective color tone of the pattern element.

BRIEF SUMMARY OF THE INVENTION

The object on which the present invention is based is achieved by the security feature according to the invention and by the valuable and/or security product, in particular valuable or security document, according to the invention, containing said security feature. The security feature contains, on and/or in a product carrier, for example in one or more pattern planes, in particular on one of the product carrier surfaces, wherein in particular an internal surface is suitable, at least one luminescence means and additionally at least one absorptive spectral filter means for luminescence radiation emitted by the at least one luminescence means. The at least one absorptive spectral filter means can also be located on one of the product carrier surfaces, in particular one of the internal surfaces.

A security feature that is visible with the eye, for example the portrait image of a person, in particular of the document owner, is formed with the at least one absorptive spectral filter means. The security feature can be formed for example by a multi-color representation of any pattern. The spectral filter means have a filtering action on the luminescence radiation emitted by the at least one luminescence means owing to their optical absorption properties in the visible spectral range. As a result, the facial image appears in color, that is to say with more than two color tones (with different color impressions that are not solely based on brightness differences), not only under normal illumination for example with white light (with spectral broadband radiation in the visible range), but also under illumination conditions under which luminescence is normally observed, i.e. no illumination with visible light, but exclusively with electromagnetic radiation with which the at least one luminescence means is excited.

By way of example, the portrait image of the document owner on an ID document has hitherto been realized only by an image which appears in multiple colors only when illuminated with light in the visible spectral range. In principle, a monochromatic shadow image could moreover be produced with a color that is luminescent in the visible spectral range and is excitable using UV radiation in order to increase the security of such documents against forgery and/or falsification and/or copying. The incorporation of RGB shadow images is known and commercially available. Owing to the inks used, however, often only incorporation in paper documents is possible. Inks and printers are currently available only to a limited extent for the secure incorporation of personalization information in a highly secure document body, which consists for example of polycarbonate. What is particularly desirable is to limit the number of print heads that are necessary. In addition, color management when producing an RGB shadow image is difficult in principle since a slight difference in excitation resulting, for example, from the selection of different commercially available UV lamps, after leads to different excitation of the three luminescence substances, such that the produced image produces in each case a slightly different color impression.

Owing to the luminescence of the at least one excited luminescence means and the spectral filtering of the luminescence light emitted thereby in the visible spectral range using the at least one absorptive spectral filter means forming the pattern, a desired multi-color pattern according to the present invention can also be reproduced in multiple colors under the verification conditions for luminescent security features. It is therefore not necessary for the luminescence pattern (that is the subject of the invention) for producing the luminescence pattern image to be formed of luminescent (basic) colors that are suitable herefor, by producing for this purpose for example print extracts with luminescent colorants suitable herefor in each case in one (basic) color (for example red, green and blue according to the RGB color space) and for the luminescence pattern then to be formed by color mixing of the luminescent print extracts. Rather, the luminescent pattern image already forms when using the design of a template, in particular a printing template, which is perceivable with visible light under conventional illumination conditions. It completely suffices in this case to filter the radiation emitted by the luminescence means by way of the colorants, for example printing paints, such that the pattern which appears in multiple colors when viewing in the visible spectral range also appears in multiple colors with substantially the same color distribution, i.e. with natural color distribution, under luminescence illumination conditions (i.e. without illumination with radiation that is visible to the human eye). Any color shift is compensated for by the human eye and still perceived as white.

Of course a pattern which is configured to be only monochromatic or black-and-white or in grey shades with conventional illumination in the visible spectral range will likewise appear to be monochromatic or black-and-white or in grey shades under luminescence viewing. To this extent, the present invention extends not only to the reproduction of multi-color patterns (for example in two, three or more colors) explained above, but also to monochromatic and black-and-white reproductions of a pattern and reproductions of a pattern appearing in grey shades. For example, a pattern will then appear under luminescence viewing conditions practically with the same color/black-and-white/grey distribution as under conventional conditions with illumination with visible light. To this extent, the security feature according to the invention can be used to represent, instead of a multi-color pattern, i.e. having more than two colors, also monochromatic or black-and-white patterns or patterns formed in grey shades.

If the luminescence radiation in the visible spectral range is of a very broadband nature, practically white luminescence light can be produced (with the possible inclusion of a slight color shift). This is achieved by additive color mixing using a plurality of broadband-emitting luminescence means, but also with a plurality of narrowband-luminescent luminescence means or with a mixture of narrowband- and broadband-luminescent luminescence means. In this case, the luminescence radiation, which has been filtered by the absorptive spectral filter means and is incident on the viewer's eye, appears in the same color as the at least one spectral filter means under normal illumination conditions in the visible spectral range. If the luminescence radiation is not white but colored, for example because specific spectral components occur proportionally to a stronger degree than others, the security feature is reproduced with a corresponding color shift. Since the human eye adapts to different color temperatures, such a color shift is, however, hardly perceived without the presence of a comparison option. Of course, the at least one spectral filter means cannot filter out any luminescence radiation by way of filtering that is not already present. Therefore, the pattern reproduction in regions, the color of the spectral filter means of which lies within a spectral range in which no luminescence radiation is emitted, will appear dark.

In order to produce the valuable and/or security product according to the invention, firstly (a) a product carrier or a preliminary product of the valuable and/or security product according to the invention is provided, subsequently (b) the at least one luminescence means and the at least one absorptive spectral filter means are applied onto at least one of the surfaces of the product carrier or of the preliminary product. The preliminary product can then be connected to further product carrier sheets or be coated with further product sheet material, such that the surface(s) that is/are provided with the at least one luminescence means and/or the at least one absorptive spectral filter means is/are arranged internally in the valuable and/or security document, specifically in one or more pattern planes.

For the verification of the valuable and/or security product according to the invention using the security feature according to the invention, (a) initially the product with the security feature is placed in an apparatus that is suitable herefor, (b) the security feature of the product is illuminated with visible light and the security feature is viewed; this either includes direct viewing by the person or machine viewing using apparatuses and image evaluation systems that are suitable herefor; and (c) the security feature of the product is illuminated with the excitation radiation for the at least one luminescence means and the security feature is viewed in the form of luminescence light emitted in the visible spectral range; the latter step also either includes direct viewing by a human or machine viewing using apparatuses and image evaluation systems that are suitable herefor. Steps b) and c) are preferably carried out successively. However, step b) is not absolutely necessary since verification is also possible by capturing the security feature solely by the filtering according to the invention of the luminescence light emitted by the at least one luminescence means by way of a pattern formed by the spectral filter means. An apparatus suitable for the verification has a holder for the product, a light source for visible light, and a light source for electromagnetic radiation in the spectral range for the excitation of the at least one luminescence means, for example a UV light source. Furthermore, a suitable optical unit, and capturing and evaluation systems can also be provided. The verification can be deemed successful if the pattern forming the security feature appears not only under illumination in the visible spectral range but also under luminescence illumination conditions (or at least under luminescence illumination conditions), and optionally also if the two pattern reproductions are reproduced identically and with a prespecified appearance.

The at least one absorptive spectral filter means can be present in particular in the form of colors prespecified according to the CMYK color space, for example in the form of printing colors with which color extracts are produced, with the color extracts together forming a pattern that is in particular colored. To this end, generally color extracts in the basic colors C (cyan) M (magenta) Y (yellow) and K (key=black component) are produced, and said color extracts are combined one above the other to form the pattern, preferably on the same surface on or in the product, with very particular preference directly one above the other, i.e. such that they are in contact with one another.

The at least one absorptive spectral filter means can be used for example by one or more printing paints or printing inks or by colorants in the form of dyes or pigments in printing paints or printing inks. The absorptive spectral filter means can be either a single colorant having a prespecified absorption and remission spectrum or a mixture of a plurality of colorants which each have an individual absorption and remission spectrum and have in the mixed form an absorption and remission spectrum that differs from the individual colorants and which is the subtractive result of the spectra of the individual colorants. The absorptive spectral filter means can be formed by one or more organic colorants or by one or more inorganic colorants or by a mixture of at least one organic and at least one inorganic colorant. Organic colorants can typically be azo compounds. Inorganic colorants can be for example carbon black and titanium dioxide. In addition, the absorptive spectral filter means can contain further typical constituent parts, for example solvents, binders, resins, varnishes and auxiliary agents such as brighteners. It is preferred in particular if the at least one absorptive spectral filter means is transparent or translucent in the manner of a glaze. It is preferred for the absorptive spectral filter means to be at least partially transparent also for the excitation radiation for the at least one luminescence means.

For example, the facial image of the document owner can be printed in color using printing paints which are suitable herefor, for example in a plurality of color extracts that can be formed for example in a pattern plane or in a plurality of pattern planes. Said printing paints have a filtering effect on the luminescence radiation emitted by the at least one luminescence means owing to their optical absorption properties in the visible spectral range. On account of the combination of the optical filter properties of the at least one absorptive spectral filter means, which has hardly any or no luminescence under excitation conditions for the luminescence means, with the at least one luminescence means, which has strong luminescence under the luminescence illumination conditions, a pattern is perceivable under the luminescence illumination conditions that appears like the pattern that is perceivable under normal viewing.

In one possible development of the present invention, the absorptive spectral filter means are not luminescent even under excitation with electromagnetic radiation. However, it can be advantageous to select at least one or more of the absorptive spectral filter means, possibly all of them, such that it is/they are luminescent in the visible spectral range under the excitation conditions for the at least one luminescence means, specifically in each case with a suitable color (i.e. with a spectral distribution of the luminescence radiation that is similar at least to that of the light remission of the absorptive spectral filter means), since as a result a more brilliant representation is achieved even when viewing the pattern under normal illumination conditions, for example the skin color of a person with a more natural appearance when a portrait image of said person is reproduced. In addition, spectral components of the pattern can thus be supplemented in which the luminescence means is not or is hardly luminescent. For example, the magenta color extract of the pattern can preferably be produced with a spectral filter means which is additionally luminous under luminescence, taking into account the color shift. Thus at least one of the at least one absorptive spectral filter means according to this preferred development of the present invention produces no luminescence radiation under excitation, while at least another absorptive spectral filter means is luminescent in the visible spectral range under the excitation conditions for the at least one luminescence means. This additional property can be achieved by the absorptive spectral filter means additionally containing, in addition to one or more colorants, one or more brighteners which are luminescent owing to the excitation with electromagnetic radiation, or by it being formed by one or more colorants which has/have, in addition to the absorptive properties, luminescent properties.

In one preferred development of the present invention, the excitation radiation used to excite the luminescence means can be narrowband (light with an emission with a peak width at half-height of at most 25 nm) or broadband (peak width at half-height of more than 25 nm).

In one preferred development of the present invention, the at least one luminescence means can be configured to be luminous in the visible spectral range through excitation using UV radiation. As a result, it is possible to represent the pattern without illumination with electromagnetic radiation in the visible spectral range. In principle, excitation using IR radiation is also possible. In this case, luminescence with anti-Stokes shift would need to be present for it to be within the visible spectral range. The pattern appears brilliant, for example, in a multi-colored presentation in an environment that is dark for the human eye, wherein under illumination with white luminescence light it appears preferably with the same color distribution as the pattern formed with the absorptive spectral filter means.

By way of example, the at least one luminescence means can be used in the form of one or more printing paints or printing inks or in the form of luminescence substances or luminescent pigments in printing paints or printing inks. In addition to the luminescence substances or luminescent pigments, the at least one luminescence means can contain further constituent parts, such as solvents, binders, resins, varnishes and auxiliary agents. The at least one luminescence means can exhibit in the visible spectral range a specific absorption or remission, i.e. be colored, or it may be colorless. It is particularly preferred if the at least one luminescence means is transparent or translucent and in particular also colorless in the manner of a glaze.

It is furthermore preferred for the at least one luminescence means to be broadband-luminescent in the visible spectral range, i.e. in a spectral range from approximately 400 nm to approximately 750 nm. If the spectral distribution of the luminescence in this range is not uniform, the emitted light is also colored, for example slightly yellowish if relatively high energetic (short-wave) spectral components occur to a lesser extent, or greenish if relatively low energetic (long-wave) and relatively high energetic spectral components occur to a lesser extent. The luminescence means can, like the absorptive spectral filter means, be formed by an individual luminescence substance, that is to say an organic or an inorganic substance, or by a mixture of a plurality of luminescence substances, that is to say organic and/or inorganic substances. Typical luminescence substances are specified for example in U.S. Pat. No. 3,474,027 A, DE 198 60 093 A and DE 10 2007 035 592 A1, the disclosure contents of which are hereby incorporated in the present application. These are host lattices doped with rare earths, wherein in particular substances doped with terbium, cerium and/or europium, such as oxysulfides and oxynitrides, are used. The pigments formed therewith can be enveloped additionally with organic substances so as to increase the quantum yield of the luminescence. In principle, organic luminescence means are also usable, such as rhodamine 6G or fluorescein.

While preferably if needed a plurality of different absorptive spectral filter means are used to form a pattern, such as to produce a multi-colored pattern, it is possible to use for producing the pattern preferably only a single luminescence means which is preferably broadband-luminescent in the entire visible spectral range or at least in a plurality of spectral ranges within the visible range. The luminescence means thus forms, as it were, illumination for the pattern that is formed with the absorptive spectral filter means. If a plurality of luminescence means are used, they can be located in particular in different area regions of the valuable and/or security product.

In order to produce the pattern with the at least one absorptive spectral filter means and/or with the at least one luminescence means, a conventional printing method can be used, for example offset printing, letter set printing, flexographic printing, a digital printing method, such as inkjet printing, intaglio printing and screen printing.

At least one luminescence pattern that is formed with the at least one luminescence means and at least one absorptive pattern that is formed with the at least one absorptive spectral filter means can be located in different pattern planes such that they are located directly on top of one another or in the same pattern plane, by forming the same layer in the latter case. Alternatively, the luminescence patterns can also be formed in at least one luminescence layer which are spaced apart from the absorptive pattern in at least one absorptive layer. By way of example, a plurality of pattern planes for the absorptive layers can be present, which are also mutually spaced apart from one another. To this end, the respective layers can be applied onto different surfaces of different films, for example onto in each case one surface of a plurality of films which are then collected and laminated together. By way of example, the at least one luminescence means can be formed in a bottom print, for example over the entire area, and individualization can be formed using the at least one absorptive spectral filter means by inkjet printing paint in a pattern plane that is located thereabove. As a result, the luminescence light can be absorbed for achieving a color impression that differs from the original color of the luminescence light, up to the complete cancelation in specific ranges.

The luminescence means can be present in an area region of the valuable and/or security product that is covered by the security feature over the entire area or preferably in the form of a pattern. Likewise, the absorptive spectral filter means can be arranged in the area region covered by the security feature over the entire area or preferably in the form of a pattern. If both the luminescence means and the spectral filter means are present in the form of patterns, that is to say in the form of the luminescence pattern and in the form of the absorptive pattern, they can be arranged preferably in accurate alignment one above the other. If the luminescence means is present in the region of the security feature over the entire area and the absorptive spectral filter means forms an absorptive pattern, the luminescence means can form for example a rear-side illumination of the absorptive pattern.

The pattern forming the security feature according to the invention can typically be formed from a multiplicity of pattern elements. Each of the pattern elements or at least part of the pattern elements is identifiable both under normal illumination conditions and under the illumination conditions suitable for luminescence perception. Accordingly, the pattern elements according to a preferred development of the present invention are formed by the at least one luminescence means and the at least one absorptive spectral filter means.

In one particular embodiment of this development of the present invention, luminescence pattern elements are formed with the at least one luminescence means, and absorptive pattern elements are formed with the at least one absorptive spectral filter means. The luminescence pattern elements and the absorptive pattern elements are preferably configured to be in each case substantially the same size and are formed, for example printed, in accurate alignment with one another onto in each case at least one surface of the product carrier or in each case at least one surface of a preliminary product. The luminescence pattern elements are accordingly located one above the other, specifically substantially in accurate alignment. Arranged above or below (in vertical direction) of the absorptive pattern elements is accordingly also the material of the luminescence means or the luminescence pattern elements and vice versa.

Arranged above and below regions outside the absorptive pattern elements, in contrast, is preferably no material of the luminescence means or are no luminescence pattern elements and vice versa. If the pattern elements are arranged in each case in a grid, the grids can be arranged to be in accurate register.

Alternatively it is of course also possible for the at least one luminescence means to form one or a plurality of continuous (gapless) or uninterrupted layer/s, which also extend/s in the regions outside the absorptive pattern elements. Said layer/s can be configured to be rastered into individual image points (pixels) or not rastered (not resolved into image points). In order to produce said luminescence pattern layer/s, a typical printing method can be used, for example a planographic printing method, such as an offset printing method. The at least one absorptive pattern layer containing the at least one absorptive spectral filter means can likewise be formed to be rastered or not rastered, for example using a planographic printing method, such as the offset printing method, or with a digital printing method, such as the inkjet printing method. The at least one luminescence pattern layer can be located preferably in one or more luminescence pattern planes which are located below one or more absorptive pattern planes in which the at least one absorptive pattern layer is formed. The inverse arrangement is likewise possible in principle. An absorptive pattern formed by the at least one absorptive pattern layer can be for example a serial number or a shadow image of the document owner.

In yet another method variant, it is furthermore also possible to form in each case preferably different patterns with the at least one luminescence means and the at least one absorptive spectral filter means in different pattern planes which may be located one above the other but not in accurate alignment, wherein at least one luminescence pattern layer that is formed with the at least one luminescence means forms a luminescence pattern that represents for example a first item of information, and at least one absorptive pattern layer that is formed with the at least one absorptive spectral filter means forms an absorptive pattern that represents for example a second item of information, which are arranged one above the other, i.e. are overlaid. In this case, too, the at least one luminescence pattern layer can be located preferably in one or more first pattern planes which are arranged below one or more second pattern planes in which the at least one absorptive pattern layer is formed. The inverse arrangement is likewise possible in principle. The luminescence pattern layer and/or the absorptive pattern layer can be produced using one of the abovementioned printing methods, for example with a planographic printing method, such as the offset printing method, or with a digital printing method, such as the inkjet printing method. A luminescence pattern that is formed by the at least one luminescence pattern layer can be, for example, a shadow image of the document owner, while an absorptive pattern that is formed by the at least one absorptive pattern layer can be, for example, a serial number, the name of the document owner, an emblem or any other pattern. The abovementioned embodiments are also possible in variants in which the pattern is formed not by pattern elements but in a representation that is not formed by pattern elements (not rastered).

It is preferred in particular if the luminescence pattern elements and the absorptive pattern elements are arranged in each case on the same surface on or in the product, and with very particular preference are arranged in direct contact with one another, that is to say lying on top of one another. The luminescence pattern elements can in this case be arranged on the absorptive pattern elements, i.e. the absorptive pattern elements are located between the luminescence pattern elements and the carrier onto which the pattern elements are applied, or the absorptive pattern elements can be arranged on the luminescence pattern elements, i.e. the luminescence pattern elements are located between the absorptive pattern elements and the carrier. If the luminescence pattern elements and the absorptive pattern elements are in this case formed on the surface of a product sheet which is covered after its formation by a further product sheet and the formed stack is subsequently processed further under lamination conditions to form a laminate, such that the luminescence and absorptive pattern elements are finally located inside the laminate, the luminescence pattern elements and the absorptive pattern elements are fused together under the conditions prevailing in the lamination (in particular at increased temperature, increased pressure) generally to form a uniform layer. In any case, the luminescence means that form the luminescence pattern elements and the absorptive spectral filter means that form the absorptive pattern elements diffuse into the sheet material of the product and there form a common pattern element layer. If the conditions necessary herefor do not suffice for a noticeable diffusion, however, two different layers, that is to say a luminescence pattern element layer in which all luminescence pattern elements produced with luminescence means are located and an absorptive pattern element layer in which all the absorptive pattern elements produced with absorptive spectral filter means are located, are formed, which layers are arranged directly on top of one another on the carrier material. During the production of the pattern elements, the luminescence pattern elements can be applied onto the carrier material first, and the absorptive pattern elements can then be formed on the luminescence pattern elements. Alternatively, the absorptive pattern elements can of course be applied onto the carrier material first and the luminescence pattern elements can be formed subsequently on the absorptive pattern elements. The abovementioned embodiments also apply to the case of non-rastered pattern layers.

Alternatively to the abovementioned embodiment with two different layers on the same surface of a product sheet, the luminescence pattern element layer and the absorptive pattern element layer can be arranged on different surfaces that are located one on top of the other (in different planes), for example on the two surfaces of the same product sheet or on surfaces of different product sheets. By way of example, the luminescence means can be formed as a bottom print on a first surface and the absorptive spectral filter means can be formed in an individualizing manner by way of inkjet printing in a plane that is located thereabove (on a second surface). The abovementioned embodiments are also possible in variants in which the pattern is not formed by pattern elements but in a representation that is not formed by pattern elements (non-rastered).

In all cases, for example if the at least one luminescence means and the at least one absorptive spectral filter means are present in a single layer that forms pattern elements, and furthermore if the at least one luminescence means on the carrier material forms luminescence pattern elements that are located at the bottom and the at least one absorptive spectral filter means forms absorptive pattern elements that are located on top, and furthermore if inversely the at least one absorptive spectral filter means on the carrier material forms absorptive pattern elements that are located at the bottom and the at least one luminescence means forms luminescence pattern elements that are located at the top, and also in cases of non-rastered pattern layers, i.e. pattern layers that are configured not in pattern elements, radiation that is incident on the pattern elements or on the non-rastered pattern layers, that is to say light in the visible spectral range, is filtered by the absorptive pattern elements or the non-rastered absorptive pattern layers such that the pattern is perceivable under normal illumination conditions with visible light in the same way as under illumination conditions that are suitable for luminescence.

Alternatively to the abovementioned embodiments, and with very particular preference, the pattern elements can be located in a single pattern element layer which contains both the at least one luminescence means and the at least one absorptive spectral filter means. To this end, the luminescence means and absorptive spectral filter means used for forming the pattern elements can be contained in a common material that is applied onto the carrier material, possibly again produced in several color extracts one above the other. The formed pattern element layer is therefore homogeneous and not constructed from two layers. Alternatively, the pattern element layer containing the at least one luminescence means and the at least one absorptive spectral filter means can also be formed initially by separate production of two layers that lie against one another and subsequently by fusing both layers, in particular at increased temperature, for example during lamination of the carrier sheet with further sheets. The embodiments mentioned above apply also to the case of non-rastered pattern layers of luminescence means and absorptive spectral filter means.

According to the abovementioned preferred embodiments, the pattern that is formed with the at least one absorptive spectral filter means and the pattern that is formed with the at least one luminescence means are thus overlaid; they are located one above the other in accurate alignment and at least in accurate register.

In all abovementioned embodiments of the present invention, the absorptive pattern can be individualizing, in particular personalizing, for the valuable and/or security product, and the luminescence pattern can be non-individualizing. Alternatively, the luminescence patterns can be individualizing and the absorptive pattern can be non-individualizing. In a particularly preferred embodiment, both patterns are individualizing. Alternatively, both patterns can be non-individualizing.

The carrier material on which the at least one luminescence means and the at least one absorptive spectral filter means are applied is a constituent part of the valuable and/or security product. By way of example it is a single carrier material sheet, which is combined with other carrier material sheets to form a stack and is then joined with these further sheets for example in a lamination method so as to form the valuable and/or security document. Alternatively, the carrier material can also be a valuable and/or security product which has already largely been finished and on the surface or surfaces of which the security feature is applied. Alternatively, the carrier material can additionally be coated, after the security feature has been applied, with a protective varnish such that the security feature is located inside the finished product and thus cannot be easily manipulated by third parties.

The valuable and/or security product can be made of a polymer, which is selected from the group comprising polycarbonate (PC), in particular bisphenol A polycarbonate, polyethylene terephthalate (PET), the derivatives thereof, such as glycol-modified PET (PETG), polyethylene naphthalate (PEN), polyvinyl chloride (PVC), polyvinyl butyral (PVB), polymethyl methacrylate (PMMA), polyimide (PI), polyvinyl alcohol (PVA), polystyrene (PS), polyvinyl phenol (PVP), polypropylene (PP), polyethylene (PE), thermoplastic elastomers (TPE), in particular thermoplastic polyurethane (TPU), acrylonitrile butadiene styrene copolymer (ABS) and the derivatives thereof, and/or paper. In addition, the product can also be manufactured from a plurality of said materials. It preferably consists of PC or PC/TPU/PC. The polymers can be present in either a filled or non-filled state. In the latter case, they are preferably transparent or translucent. If the polymers are filled, they are opaque. The above details relate both to films that are to be joined and to liquid formulations which are applied onto a preliminary product, such as a protective varnish. The product is preferably manufactured from 3 to 12, preferably 4 to 10 films (including the carrier of the data transmission device). A laminate that is formed in such a way can subsequently be coated on one or both sides with a protective varnish. Overlay sheets that are formed in such a way protect a security feature that is located thereunder and/or impart the necessary abrasion resistance to the document. The security feature is preferably formed on one of the inner sheets.

The valuable and/or security document can have, in addition to the security feature according to the invention, further security features, for example guilloches, micro-text, holograms, kinegrams and the like. The document can furthermore also have electronic components, such as for example an RFID circuit with an antenna and RFID microchip, electronic display elements, LEDs, touch-sensitive sensors and the like. The electronic components can be arranged for example hidden between two opaque sheets of the document.

BRIEF DESCRIPTION OF THE SEVERAL VIEWS OF THE DRAWING

The figures described below serve for more detailed explanation of the invention.

In the figures, identical reference numerals designate elements having the same function.

DESCRIPTION OF THE INVENTION

Figure 1:
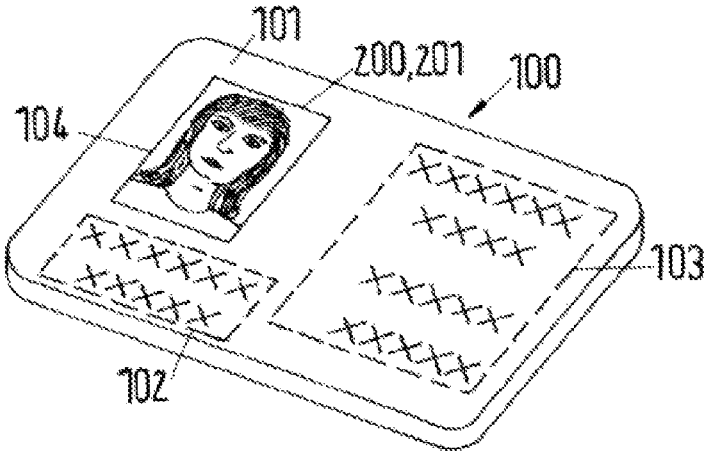
FIG. 1 shows a valuable and/or security document with a facial image of the document owner in a perspective view.
Figure 6A:
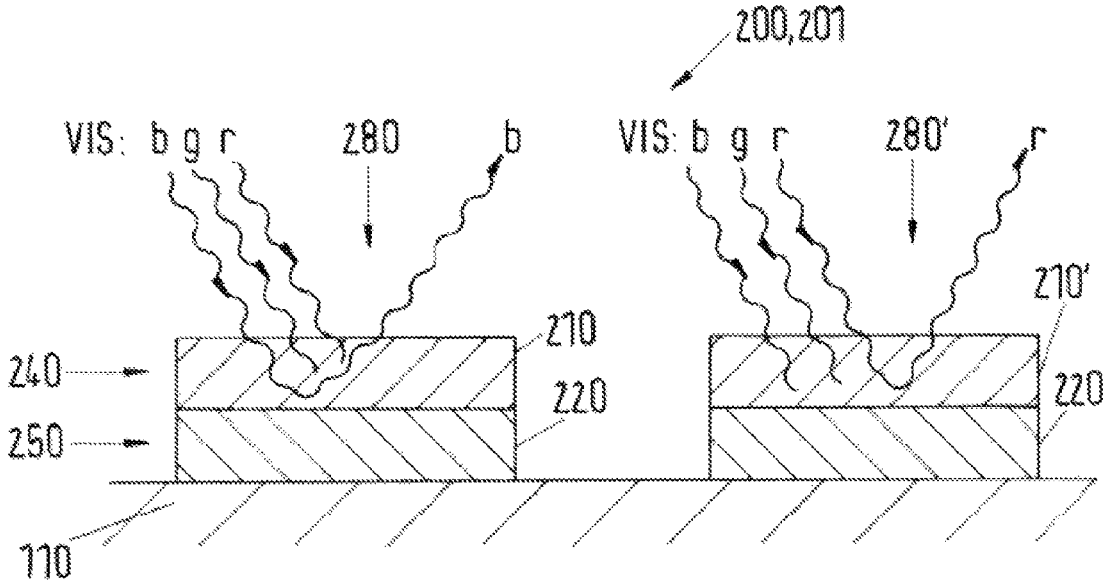
FIG. 6 shows two different pattern elements having in each case one absorptive pattern element that is located on top in schematic sectional views for illustrating the conditions of light absorption and remission: (a) when viewing with light in the visible spectral range; (b) when viewing under luminescence conditions.
Figure 7:
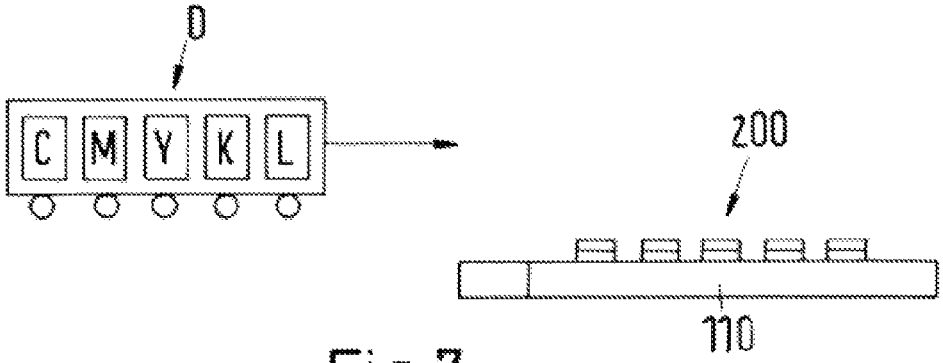
FIG. 7 shows an arrangement of an inkjet printer having five print heads and a product carrier with pattern elements in schematic view.

The valuable and/or security document 100 shown in FIG. 1 is an ID card, which was produced for example by laminating a plurality of product sheets made of polycarbonate. Said ID card has, on the upper side 101 thereof shown here, in fields 102, 103, 104, diverse details relating to the card owner, including a facial image of said card owner. These details represent personalization details. The facial image is a security feature 200 and represents a pattern 201 made of pattern elements which are formed, in a manner according to the invention, of absorptive pattern elements 210 and luminescence pattern elements 220 (in a structure for example as shown in FIG. 6*a*). The facial image is formed using a printing method, for example an inkjet printing method. So as to be able to reproduce the facial image in color, a plurality of print extracts were produced and printed one on top of the other (not illustrated). By way of example, the various print extracts can be produced successively on the same surface in one printing cycle in an inkjet printing method using the absorptive spectral filter means necessary herefor and the luminescence means which are applied by corresponding print heads of the printer. To this end, the inkjet printer D can have, in addition to the print heads for the colors cyan (C), magenta (M), yellow (Y) and key (K), a further print head (L) with which the luminescence pattern elements are printed. An apparatus that is suitable for this purpose is shown in FIG. 7. One advantage of this procedure is that no adjustment step is necessary and the manufacturing time is thus extraordinarily short. Alternatively, the printer can merely have the four print heads C, M, Y, K, wherein each of the four printing colors is present in the form of an absorptive spectral filter means suitable herefor in a mixture with a luminescence means L, wherein all printing colors contain the same luminescence means. So as to protect the facial image and the remaining details relating to the document owner against forgery and/or falsification and/or copying, the upper side of the card has subsequently also been coated with an overlay layer made of an abrasion-resistant material, for example of PET or a protective varnish (not illustrated).

Figure 2A:
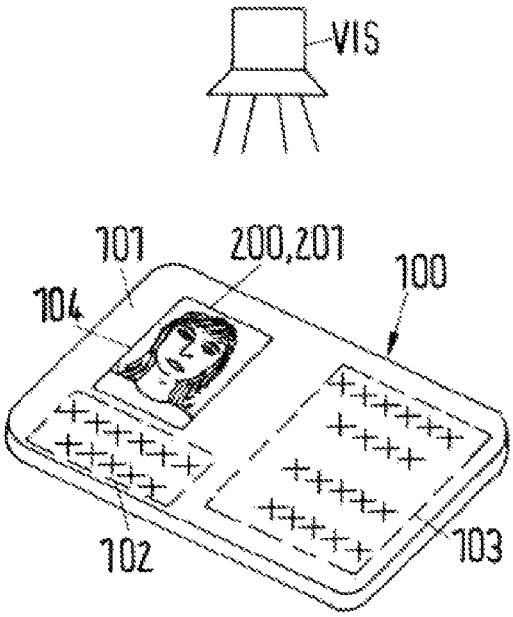
FIG. 2 shows an arrangement for verification of the genuineness of the valuable and/or security document of FIG. 1 under illumination conditions with light in the visible spectral range (a); under illumination conditions with UV light (b)
Figure 2B:
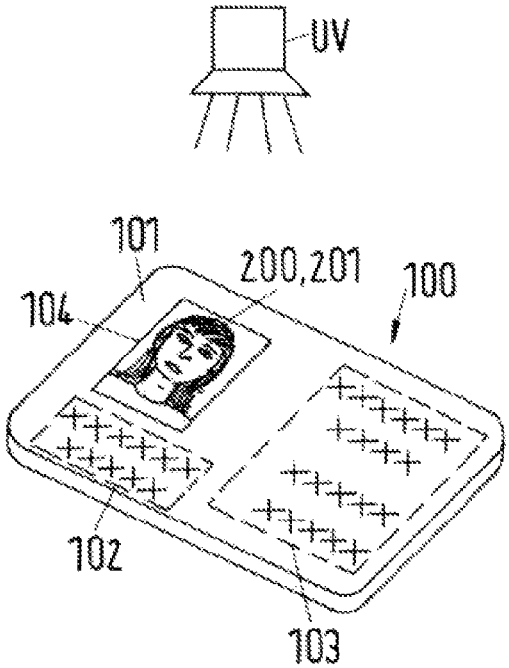

For the verification of the document 100, said document is illuminated under conventional illumination with a substantially white light source VIS (FIG. 2*a*). The facial image 200 appears in color under these illumination conditions and naturally reproduces the image of the document owner. In addition, the ID card can also be examined under illumination conditions in which it is illuminated exclusively with UV excitation radiation, i.e. except for the luminescence, the illumination space is completely or at least largely dark. For this purpose, a UV light source UV is used, which emits for example electromagnetic radiation at 365 nm. Since the luminescence means is illuminated by the UV excitation radiation and therefore emits luminescence radiation which is in turn filtered by the absorptive spectral filter means, the facial image appears in color even under these illumination conditions, specifically is luminous (FIG. 2*b*).

Figure 3A:
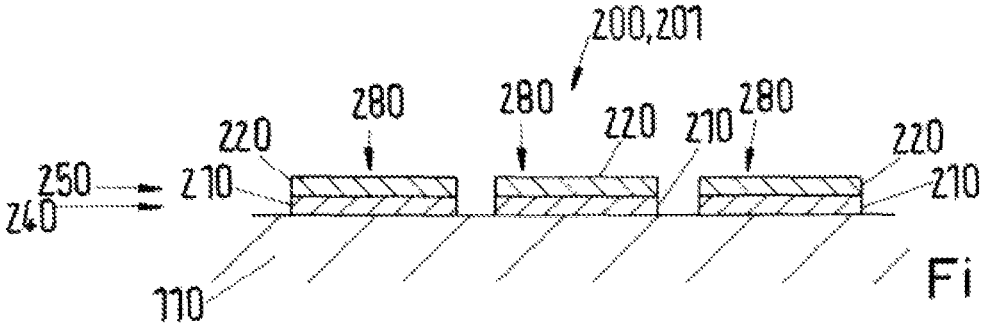
FIG. 3 shows embodiments of the arrangement of absorptive and luminescence pattern elements in schematic sectional views: (a) with luminescence pattern elements located on top; (b) with absorptive pattern elements located on top; (c) with pattern elements which contain at the same time at least one absorptive spectral filter means and at least one luminescence means; (d) as (c), but located inside between two product sheets.

FIG. 3 shows a plurality of options for forming the pattern elements 280 that form the pattern 201 and are formed by the at least one absorptive spectral filter means and the at least one luminescence means. The pattern consists of a plurality of pattern elements which together form the pattern that is perceived by the observer. Instead of a pattern that is rastered in this manner, said pattern can also be configured in non-rastered form. The individual pattern elements can be formed according to FIGS. 3*a* to 3*d* in different ways or in a carrier 110, for example printed thereon:

According to FIG. 3*a*, first absorptive pattern elements 210, which are formed by the at least one absorptive spectral filter means, are formed on the carrier 110 in the form of an absorptive pattern element layer 240. The pattern elements 280 in this and the following examples are illustrated merely by way of example relative to one another. It is of course also possible for the pattern elements to be produced at least partially also such that they join one another directly and/or overlap one another. Conventional printing colors can be formed using the at least one absorptive spectral filter means. It is possible to produce and print in particular a plurality of print extracts with different printing colors which together form the colored pattern, for example the facial image 200 in FIG. 1. Subsequently, luminescence pattern elements 220, which are formed by the at least one luminescence means, are produced on the absorptive pattern elements in the form of a luminescence pattern element layer 250. The luminescence means can contain for example at least one luminescence substance, for example rhodamine 6G or fluorescein or a mixture of said substances. One of the printing colors can additionally have a luminescence, for example in a magenta color. The luminescence pattern elements are formed largely in accurate alignment on the absorptive pattern elements.

The produced pattern 201 shows a colored representation both when illuminated with visible light (VIS) and when excited with UV light (UV).

Figure 3B:
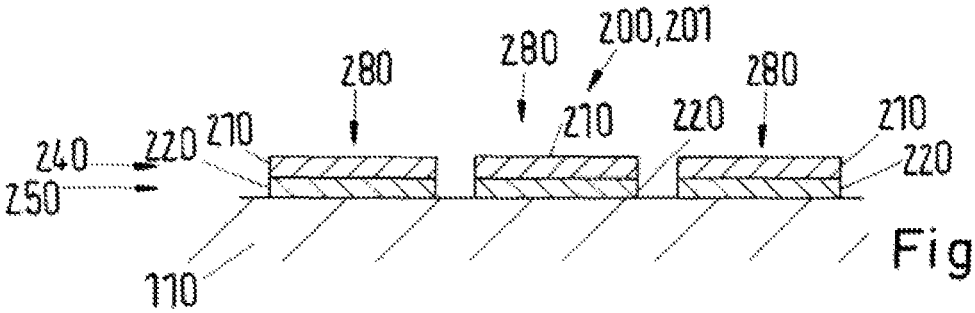

According to FIG. 3*b*, initially luminescence pattern elements 220, which are formed by the at least one luminescence means, are produced on the carrier 110 in the form of a luminescence pattern element layer 250. Subsequently, absorptive pattern elements 210 are formed on the luminescence pattern elements in the form of an absorptive pattern element layer 240. The absorptive pattern elements are also formed largely in accurate alignment on the luminescence pattern elements. With respect to the structure of the pattern elements 280 made of absorptive and luminescence pattern elements and the selection of the luminescence means and absorptive spectral filter means, reference is made to the example in FIG. 3*a*.

The produced pattern 201 exhibits a colored representation both when illuminated with visible light (VIS) and when excited with UV light (UV).

Figure 3C:
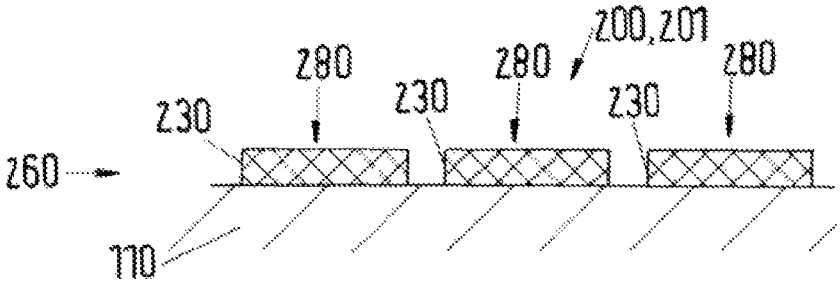

According to FIG. 3*c*, pattern elements 280 are formed on a carrier 110 in the form of combination pattern elements 230 which form a pattern element layer 260 and which are formed both by the at least one luminescence means and by the at least one absorptive spectral filter means. With respect to the selection of the luminescence and absorptive spectral filter means, reference is made to the example in FIG. 3*a*. The pattern elements are also produced in this case in a plurality of color extracts. To this end, color material that contains in each case at least one luminescence means and, depending on the color extract, one of a plurality of absorptive spectral filter means is used.

The produced pattern 201 exhibits a colored representation both when illuminated with visible light (VIS) and when excited with UV light (UV).

Figure 3D:
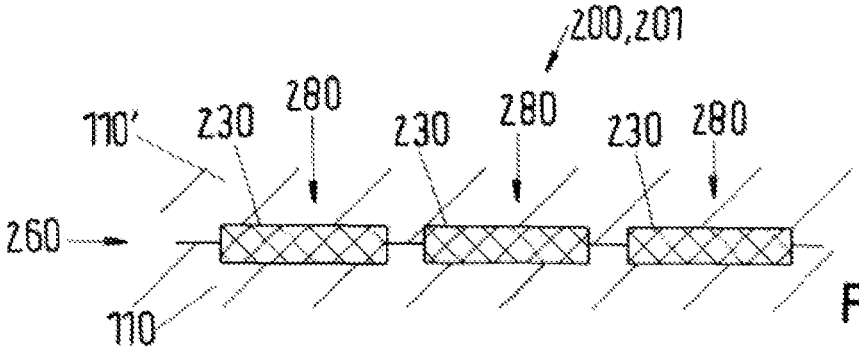

A single pattern element layer 260 made of pattern elements 280 is produced for example even if absorptive pattern element layers 240 and luminescence pattern element layers 250 which are located on top of each other (such as according to FIG. 3*a* or 3*b*) are formed on a product sheet 110, and said product sheet is then combined with a further product sheet 110' and processed further, under the action of increased temperature and increased pressure, to form a laminate. In this case, the luminescence means and absorptive spectral filter means diffuse into the adjoining product sheets 110, 110' and also in each case into one another, such that a single pattern element layer 260 made of combined luminescence and absorptive pattern elements is formed (FIG. 3*d*).

Figure 4A:
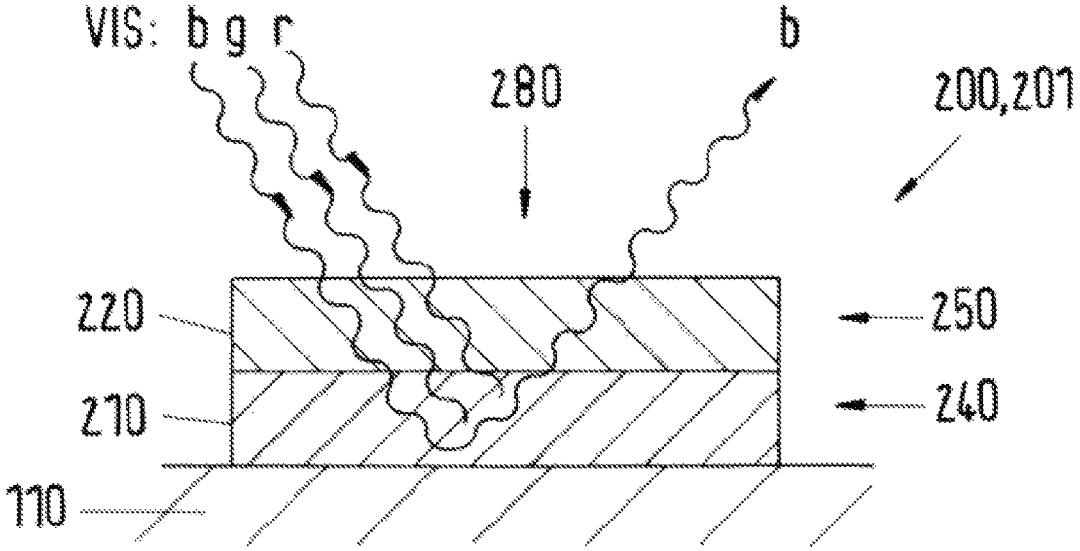
FIG. 4 shows a pattern element with a luminescence pattern element that is located on top in schematic sectional views for illustrating the conditions of light absorption and remission: (a) when viewing with light in the visible spectral range; (b) when viewing under luminescence conditions.
Figure 4B:
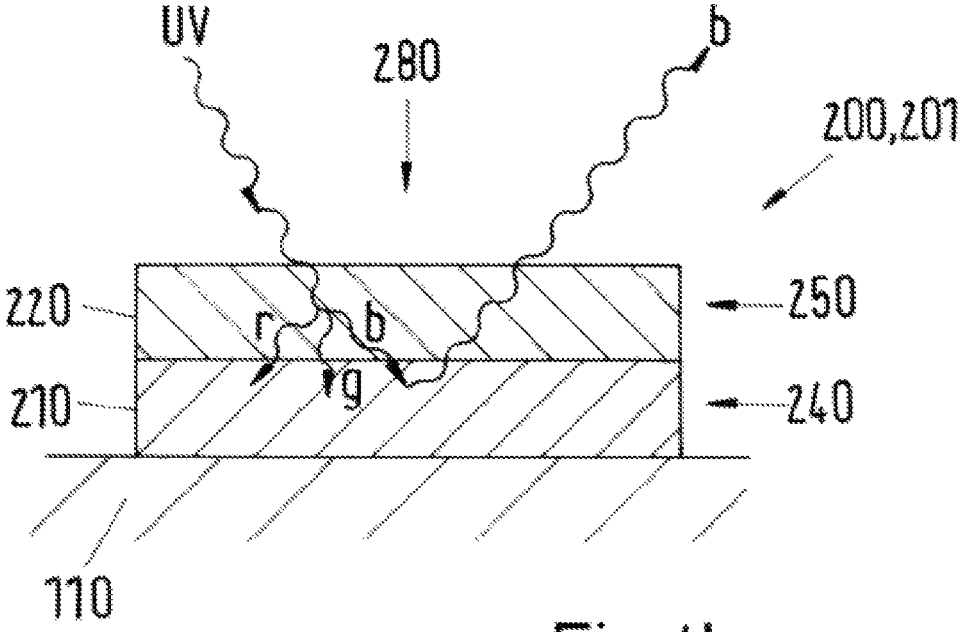

FIG. 4 shows the conditions under irradiation with white light (VIS) (FIG. 4*a*) and under UV radiation (UV), for example with narrowband radiation at 312 nm, (FIG. 4*b*). The visible light is symbolized by the basic colors blue (b), green (g) and red (r). These color components pass through the luminescence pattern element 220 that is located on top, without being absorbed by it or scattered by it to any significant extent. To this end, the at least one luminescence means, which forms said luminescence pattern element, is entirely or at least largely radiation-transmissive in the visible spectral range and also preferably non-scattering, and therefore transparent (or, if appropriate, translucent) and colorless (or colored only slightly). The absorptive pattern element 210, which is located in FIG. 4*a* under the luminescence pattern element, has red and green absorption and therefore appears to be blue to the human eye. For this reason, the red component (r) and the green component (g) of the incident light are absorbed in the absorptive pattern element 210, while the blue component (b) passes through the absorptive pattern element and is remitted. On account of the remission of said light component, the pattern element 280 appears blue.

FIG. 4*b* shows the conditions under illumination only with UV light (UV). The UV radiation entering the pattern element 280 produces, in the luminescence pattern element 220 that is located on top, nearly white luminescence light with the color components blue (b), green (g) and red (r). Said radiation is emitted without a specific direction and passes into the absorptive pattern element 210 located thereunder, where it is filtered: the red component (r) and the green component (g) are absorbed in the absorptive pattern element, while the blue component (b) passes through and is remitted. As a result, said pattern element appears to be luminous in blue on account of the UV excitation.

Figure 5A:
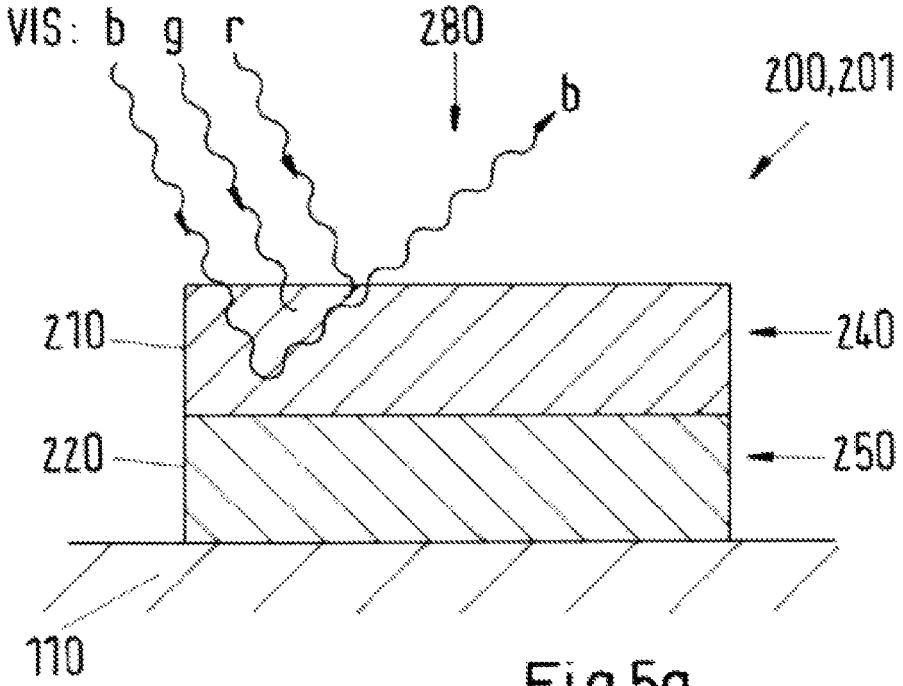
FIG. 5 shows a pattern element with a luminescence pattern element that is located at the bottom in schematic sectional views for illustrating the conditions of light absorption and remission: (a) when viewing with light in the visible spectral range; (b) when viewing under luminescence conditions.
Figure 5B:
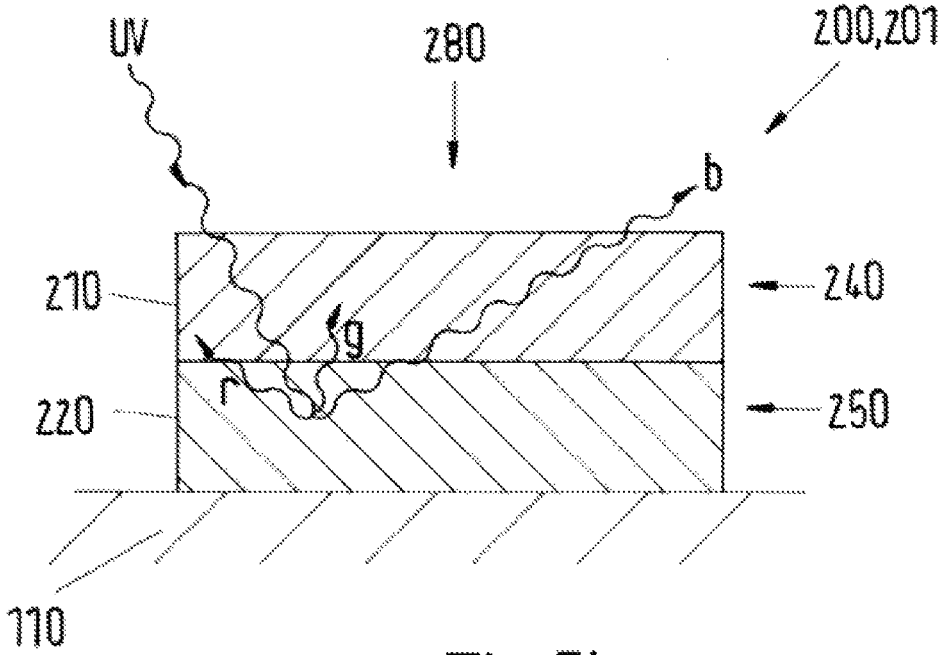

The same conditions come about also when a luminescence pattern element 220 is located at the bottom and an absorptive pattern element 210 is located on top, which form in each case a luminescence pattern element layer 250 and an absorptive pattern element layer 240 (FIG. 5). Under illumination with visible light (VIS) (FIG. 5*a*), in this case the red component (r) and the green component (g) are already absorbed in the absorptive pattern element that is located on top, such that the pattern element 280 appears blue overall. Under illumination with UV radiation (UV) (FIG. 5*b*), said illumination passes through the absorptive pattern element. To this end it is of course necessary for said absorptive pattern element to be transmissive for UV radiation and if possible not be scattered. Broadband visible luminescence radiation having a blue component (b), a green component (g) and a red component (r) is produced in the luminescence pattern element. Only the blue component of said radiation can pass through the absorptive pattern element that is located on top since the green component and the red component are filtered out by the absorptive pattern element.

Figure 6B:
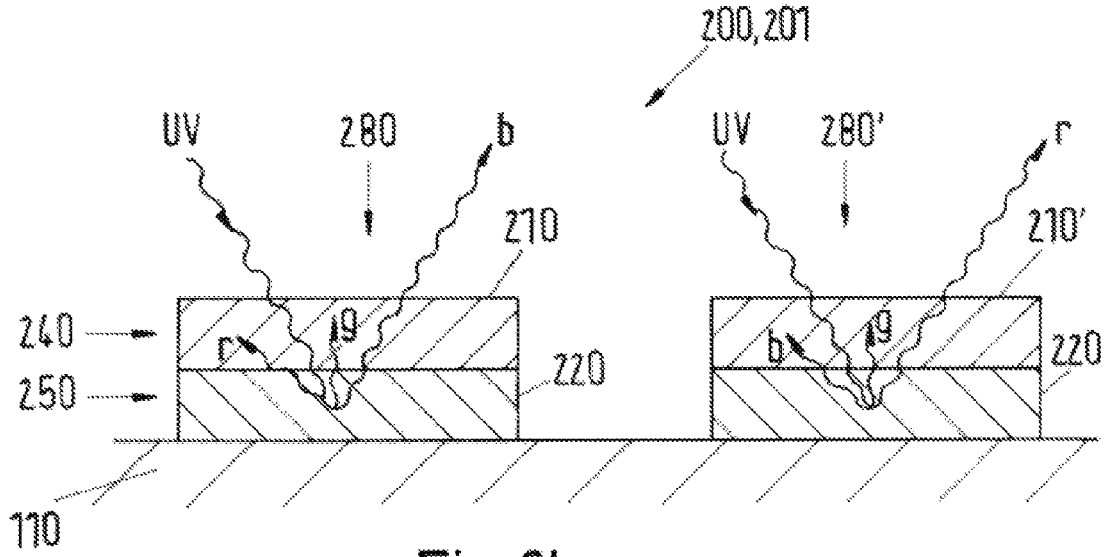

FIG. 6 furthermore shows the conditions with two different pattern elements 280, 280', which differ from one another with respect to the spectral absorption of the absorptive pattern element 210, 210'. The luminescence pattern elements 220 are located at the bottom and the absorptive pattern elements 210, 210' are located on top. The luminescence pattern elements together form a luminescence pattern element layer 250, and the absorptive pattern elements together form an absorptive pattern element layer 240. The two luminescence pattern elements are formed with the same luminescence means. By contrast, in each case different absorptive spectral filter means are present in the two absorptive pattern elements. The left-hand pattern element 280 that is located on top in each case has an absorptive pattern element 210, which absorbs the red component (r) and the green component (g) of visible radiation (VIS) and appears blue (b), and the in each case right-hand pattern element 280' has an absorptive pattern element 210' which absorbs the blue component (b) and the green component (g), such that said pattern element 280' appears red (r). This structure corresponds to that shown in FIG. 5.

FIG. 6*a* shows the situation for illuminating and viewing the pattern with visible light (VIS), and FIG. 6 with UV excitation radiation (UV). Of the visible radiation, only the blue component (b) is remitted in the left-hand pattern element 280, while this is the red component (r) in the right-hand pattern element 280'. For this reason, the left-hand pattern element is perceived as blue and the right-hand pattern element as red when illuminated with visible light. With UV radiation, a corresponding image appears as follows: the red component (r) and the green component (g) of the luminescence light are absorbed in the left-hand absorptive pattern element 210 that is located on top, such that only the blue component (b) of the luminescence light is emitted by the left-hand pattern element 280, while in the right-hand absorptive pattern element 210' that is located on top the blue component (b) and the green component (g) of the luminescence light are absorbed and only the red component (r) of the luminescence light is emitted by the right-hand pattern element 280'. For this reason, the pattern 201 produced by luminescence looks substantially like the pattern obtained under visible light radiation.

In a further exemplary embodiment according to the invention, a luminescence layer with a luminescence means and an absorptive layer with an absorptive spectral filter means are formed by printing them directly one on top of the other onto the same surface of a polymer film. The luminescence means are luminous in approximately white under excitation with UV radiation. The two layers are produced using inkjet print. The absorptive layer is formed on the luminescence layer that is printed first. In FIGS. 8A, 8B, 8C and 8D, different examples are indicated. In each case shown to be located on top (I) are luminescence patterns that are formed with luminescence means, and thereunder (II) absorptive patterns that are formed with absorptive spectral filter means. Shown to be at the very bottom (III) are in each case the patterns that are printed on top of one another to form an overall pattern.

According to the example of FIG. 8A, the first name of the document owner and the date are printed in the luminescence color and the owner's facial image is printed with a conventional printing paint which contains an absorptive spectral filter means. Together, this gives an overlay of the first name of the document owner and the date with the facial image thereof, with the first name and the date becoming visible only if the representation is irradiated with UV radiation. In the regions of the first name and of the date, which are not overlaid by the facial image, they appear in the original luminescence color of the luminescence means, that is to say approximately white. In the regions that are overlaid by the facial image, the first name and the date appear in the color of the facial image even under luminescence illumination conditions.

According to the example of FIG. 8B, a full-area field is printed with the luminescence color and the facial image of the document owner is printed with a conventional printing paint which contains an absorptive spectral filter means. Together this gives an overlay of the field with the facial image of the document owner, with the field being visible only if the representation is irradiated with UV radiation. In the regions of the field that are not overlaid by the facial image, the field appears in the original luminescence color of the luminescence means, that is to say approximately white. In the regions which are overlaid by the facial image, the field appears in the color of the facial image under luminescence illumination conditions.

According to the example of FIG. 8C, the facial image of the document owner is printed in the luminescence color and the facial image thereof is printed in addition with a conventional printing paint that contains an absorptive spectral filter means, one on top of the other in accurate alignment. Together, the facial image of the document owner appears under illumination with visible light in a natural color distribution and under illumination with UV radiation likewise with the natural color distribution.

According to the example of FIG. 8D, a line pattern is printed in the luminescence color and the facial image of the document owner is printed with a conventional printing paint which contains an absorptive spectral filter means. Together this forms an overlay of the line pattern with the facial image of document owner, with the line pattern becoming visible only if the representation is irradiated with UV radiation. In the regions of the line pattern that are not overlaid by the facial image, the line pattern appears in the original luminescence color of the luminescence means, that is to say approximately white. In the regions which are overlaid by the facial image, the line pattern appears under luminescence illumination conditions in the color of the facial image.

Figure 8:
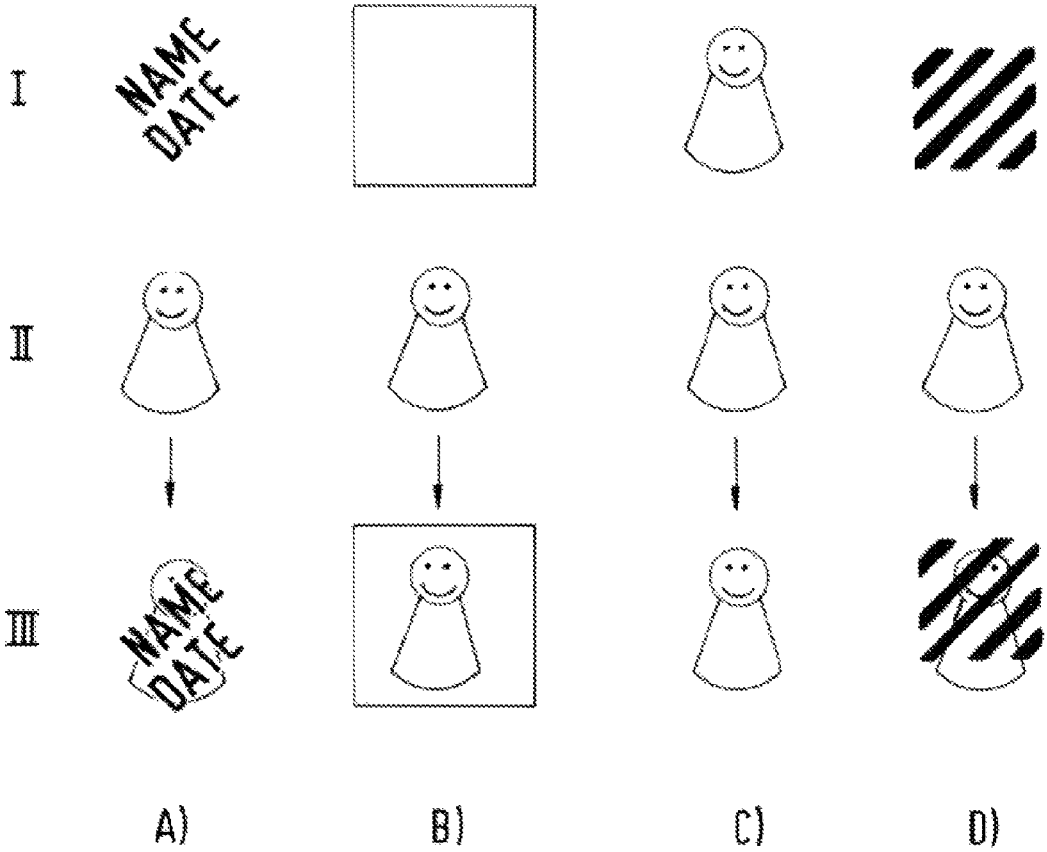
FIG. 8 shows the structure for inkjet printing of the absorptive spectral filter means and of the luminescence means in schematic illustration.

The luminescence layer in the examples of FIG. 8 can be configured either in rastered or non-rastered print. Said print can also be produced by a planographic method, such as the offset printing method. In the same way, the absorptive layer in these examples can be configured to be either rastered or non-rastered. Preferably, at least the absorptive pattern is produced by a digital printing method, such as inkjet method, so as to use the flexibility thereof for personalizing patterns.

The invention claimed is:

1. A security device, comprising:

a product carrier;

a security feature in and/or on said product carrier, said security feature including:

at least one luminescence means and at least one absorptive spectral filter for filtering a luminescence radiation emitted by said at least one luminescence means;

said at least one absorptive spectral filter being luminescent in a visible spectral range under excitation conditions for said at least one luminescence means;

said at least one luminescence means and said at least one absorptive spectral filter forming a pattern with a plurality of pattern elements each formed by said at least one luminescence means and said at least one absorptive spectral filter means; and wherein luminescence pattern elements, formed by said at least one luminescence means, and absorptive pattern elements, formed by said at least one absorptive spectral filter means, are configured with equal size and disposed above one another in accurately aligned registration.

2. The security device according to claim 1, wherein said at least one luminescence means is configured to luminesce in the visible spectral range by excitation with UV radiation.

3. The security device according to claim 1, wherein at least one of said at least one absorptive spectral filter produces no luminescence radiation under irradiation.

4. The security device according to claim 1, wherein said at least one absorptive spectral filter is contained in at least one pattern formed with printing colors according to a CMYK color space.

5. The security device according to claim 1, wherein said luminescence pattern elements and said absorptive pattern elements are in each case arranged in direct contact with one another.

6. The security device according to claim 1, wherein said pattern elements are disposed in a pattern element layer containing both said at least one luminescence means and said at least one absorptive spectral filter.

7. The security device according to claim 1, wherein said at least one luminescence means forms a luminescence pattern and said at least one absorptive spectral filter forms an absorptive pattern and wherein the luminescence pattern and the absorptive pattern are in each case individualizing for a valuable and/or security product formed therewith.

8. The security device according to claim 1, wherein said at least one luminescence means forms a luminescence pattern and said at least one absorptive spectral filter forms an absorptive pattern and wherein the luminescence pattern and the absorptive pattern are formed by a single pattern layer which contains both said at least one luminescence means and said at least one absorptive spectral filter.

* * * * *